United States Patent [19]

Agnew

[11] 4,008,414

[45] Feb. 15, 1977

[54] CIRCUIT FOR POWERING FLUORESCENT LAMPS

[75] Inventor: Donald L. Agnew, Long Beach, Calif.

[73] Assignee: Power Saver Corporation, Bellflower, Calif.

[22] Filed: July 28, 1975

[21] Appl. No.: 599,378

[52] U.S. Cl. ..... 315/97; 315/101; 315/105; 315/122; 315/189; 315/210; 315/324; 315/DIG. 7

[51] Int. Cl.[2] ..... H05B 41/24; H05B 41/29

[58] Field of Search ..... 315/94, 95, 97, 100, 315/101, 105, 119, 121, 122, 125, 189, 210, 312, 324, DIG. 5, DIG. 7; 339/57; 240/51.11 R

[56] References Cited

UNITED STATES PATENTS

| | | | |
|---|---|---|---|
| 2,637,833 | 5/1953 | Skrotzki | 315/DIG. 5 |
| 2,774,917 | 12/1956 | Passmore | 315/97 X |
| 3,629,648 | 12/1971 | Brown et al. | 315/101 X |
| 3,869,640 | 3/1975 | Kolomyjec | 315/97 |
| 3,882,354 | 5/1975 | May | 315/105 X |

*Primary Examiner*—Eugene R. LaRoche
*Attorney, Agent, or Firm*—Kleinberg, Morganstern, Scholnick & Mann

[57] ABSTRACT

A circuit employing an oscillator having a feedback loop for supplying operating current at a frequency in the range 20–25 kilohertz to a pair of fluorescent lamps connected in series. The heater filament of the first lamp is made a series element in the feedback loop of the oscillator, so that removal of that lamp disables the oscillator. Switching means is provided to bypass the open socket terminals of the second lamp when it is removed from its sockets, permitting power to continue to be supplied to the first lamp.

14 Claims, 1 Drawing Figure

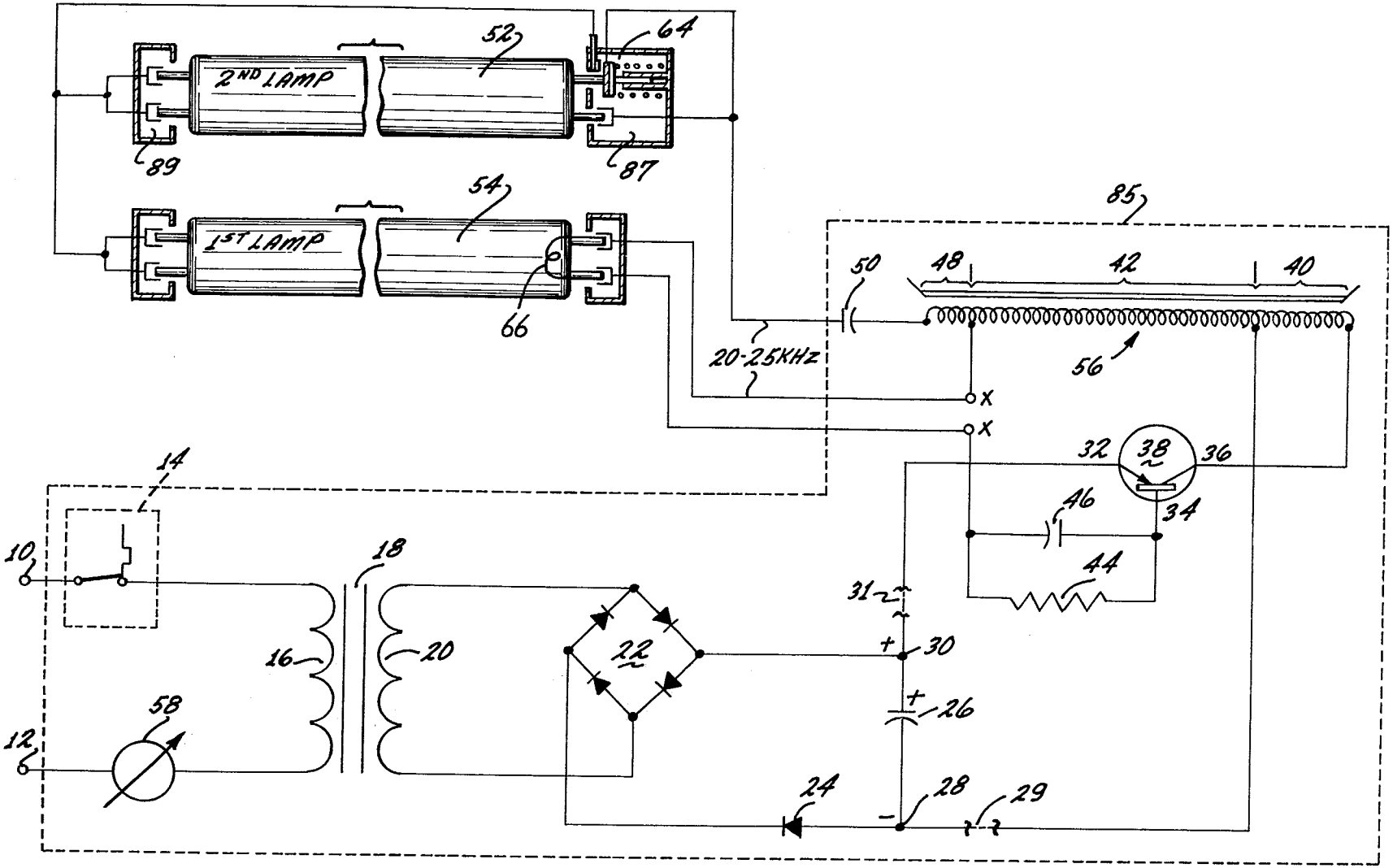
2ND LAMP
1ST LAMP
20-25KHz

CIRCUIT FOR POWERING FLUORESCENT LAMPS

BACKGROUND OF THE INVENTION

Field of the Invention

The present invention is in the field of fluorescent lamps and specifically relates to an improved circuit used to supply operating power to the lamps.

Fluorescent lamps have a very high electrical resistance until the mercury vapor within them has been ionized. Ionization may be accomplished by the use of heater filaments typically located at the ends of the lamp envelope, or by application of an initial high voltage. After ionization the resistance is much less and the lamps typically have a negative resistance characteristic.

Conventional circuits for powering the fluorescent tubes use a ballast to limit the steady state current through the lamp to a value which is safe and compatible with the desired light output and life of the lamp. Typically such ballasts use an inductive reactance to limit the operating current, usually in the form of a high reactance transformer. Conventional ballasts are large, heavy, expensive, and electrically inefficient wasting a substantial percentage of the power supplied to the lamp installation. The desirability of eliminating the ballast has long been known in the art.

For example, Kriege in U.S. Pat. No. 3,778,677 issued Dec. 11, 1973, raises the electrical potential of both filaments to a high A.C. voltage (of the order of 500 volts) above the ground potential, which induces ionization inside the lamp by capacitive coupling to the ground plane. Sammis in U.S. Pat. No. 3,525,901 issued Aug. 25, 1970, applies an alternating voltage of ultrasonic frequency to facilitate starting the discharge which is then sustained by a direct current. Similarly, Miyajima in U.S. Pat. No. 3,631,317 applies a unidirectional pulse train to facilitate starting.

The present invention eliminates the need for using a ballast with conventional fluorescent lamps, through means which will be described below. Elimination of the ballast, although desirable is not the main feature of the present invention.

One embodiment of the present invention makes use of a switch located in the fluorescent tube socket and actuated by removal of the tube, not unlike the switch used by Peterson in U.S. Pat. No. 2,522,111 issued May 8, 1951. Peterson used a switch to interrupt the primary power supply, and in Peterson's invention the full primary voltage would be present between the switch contacts which are open when the fluorescent tube is removed presenting a safety hazard. In the present invention, the switch contacts are closed when the tube is removed and the safety hazard is eliminated. In the present invention, a switch is used in a feedback loop to disable the converter but not the primary supply as in Peterson. Thus, it is not the switch which is novel in the present invention, but rather the use made of it in combination with the remaining circuitry.

SUMMARY OF THE INVENTION

In the present invention, the primary power source may be the conventional alternating current supplied by public utilities or it may be a battery for supplying a direct current of an appropriate voltage. This primary power is converted by the apparatus of the present invention to an alternating current having a frequency in the region from 20 to 25 KHz.

That frequency range has been found to be particularly advantageous for the operation of fluorescent lamps. The life of the lamps is increased several hundred percent, the luminous output is 10 percent greater, and the power consumed is 35 percent less than in the conventional method of operating the fluorescent lamps.

A novel feature of the present invention is the use of the heater filament of one of the lamps as a series element in the feedback loop of the relaxation oscillator used to convert the primary power to the higher frequency applied to the lamps. Through this means, the relaxation oscillator is disabled when the lamp is removed from its socket. This prevents thermal runaway of the relaxation oscillator when both lamps are removed from the circuit.

Another novel feature of the circuit is the provision of a bypass switch associated with the second lamp and actuated by removal of the second lamp from its socket. This bypass switch, when actuated, establishes a short circuit between the socket terminals of the second lamp, permitting the first lamp to continue to operate. Safety is assured because there can be no voltage difference between the terminals of the open sockets.

The novel features which are believed to be characteristic of the invention, both as to organization and method of operation, together with further objects and advantages thereof, will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

The FIGURE is a circuit diagram of a preferred embodiment of the apparatus of the present invention, showing how the parts are interconnected.

DESCRIPTION OF THE PREFERRED EMBODIMENT

The circuit shown in the FIGURE consists of two main sections. The first section of the circuit, extending from the main power line 10 and 12 to points 28 and 30 in the circuit, comprises a direct current power supply including a transformer 18, full-wave bridge rectifier 22, blocking diode 24 and smoothing capacitor 26.

The next part of the circuit is a blocking oscillator including a transistor 38, an autotransformer 56 and associated resistor 44 and capacitor 46. The output of the blocking oscillator is coupled to the fluorescent lamps 52 and 54 through the autotransformer 56.

Line voltage on lines 10 and 12 is supplied to the primary winding 16 of the transformer 18. A temperature activated switch 14 is placed in the primary circuit as a safety precaution. Also, a reactance dimmer 58 may be connected in the primary circuit. The dimmer is an optional feature permitting the fluorescent lamps to be dimmed so as to consume less power or to generate less light, if desired. The transformer 18 reduces the line voltage on the primary winding to a voltage of typically 12 to 48 volts on the secondary winding 20. The current in the secondary circuit is rectified by the full-wave bridge rectifier 22 and is smoothed by the smoothing capacitor 26. If desired, a blocking diode shown as 24 may be included in the output lead of the rectifier circuit, to prevent damage in case the plus and minus leads are inadvertently interchanged.

When the circuit is first activated, the forward bias between base 34 and emitter 32 causes a rapid rise in current in the emitter-base circuit. This in turn causes a rapid build-up of current in the collector circuit which current flows through windings 40 of the autotransformer 56. As the current builds up in windings 40 of the autotransformer 56 a voltage is induced in windings 42 of the autotransformer 56. This induced voltage charges capacitor 46 through the small forward resistance of the base-emitter diode and appears across the resistor 44 further increasing the forward bias between base 34 and emitter 32, thereby accelerating the flow of current through the collector circuit.

After the initial transient, the transistor 38 becomes saturated and further increase in current is not possible. As a result, the voltage induced in windings 42 decreases and capacitor 46 begins to discharge through resistor 44. At the same time the magnetic field surrounding winding 42 begins to collapse and induces a voltage in windings 42 of polarity opposite to the originally induced voltage. This drives the base of the transistor positive and the base and collector currents fall to zero. This latter condition prevails until capacitor 46, discharging through resistor 44, reaches the point at which the transistor is again forward biased, at which point the cycle begins again.

The result of this relaxation oscillation is that the current in windings 42 of the autotransformer 56 alternately reverses direction, thereby inducing corresponding alternating voltages in windings 40, 42, and 48 of the autotransformer 56 across which the fluorescent lamps 52 and 54 are attached. It is desirable to operate two fluorescent lamps in series rather than a single lamp to provide protection against thermal runaway in case one of the fluorescent lamps burns out. The capacitor 50 is a current limiting capacitor to provide additional safety.

Switch 64 is provided to establish a short circuit between the terminals of the sockets 87 and 89 in which lamp 52 is normally mounted when lamp 52 is removed from its sockets. Because lamps 52 and 54 are connected in series, lamp 54 would not operate when lamp 52 is removed, were it not for this bypass circuit.

In one embodiment of the present invention, switch 64 is located in one of the sockets of lamp 52. The switch is comprised of spring actuated contacts held apart by a prong terminal part of lamp 52 when the lamp is in the socket, and urged together by the spring force when the lamp 52 is removed from its socket. Other embodiments for switch 64 are obvious, and it is not the construction of the switch that is claimed as novel. Because the contacts of the switch are closed when the tube 52 is removed from its socket, no safety hazard is presented.

Because the heater filament 66 of lamp 54 is connected in series with the feedback circuit of the relaxation oscillator, removal of lamp 54 will interrupt the feedback current thereby disabling the relaxation oscillator. Thus, removal of either lamp or both lamps may be made without danger of thermal runaway or safety hazard.

Provision of switch 64 results in a novel feature of the present invention. It permits the advantages of series operation of the lamps to be obtained, while eliminating one of the disadvantages. Lamp 54 will still remain in operation even when lamp 52 has been removed from the series circuit. Thus, lamp 54 could provide light to permit safe and expeditious replacement of lamp 52.

Provision of switch 64 produces a further novel feature. Were switch 64 not present, removal of lamp 52 would result in the relaxation oscillator being presented with an open circuit and hence unloaded. This would cause thermal runaway and resultant loss of the transistor 38, a well known phenomenon associated with relaxation oscillators. Switch 64 assures that the load circuit always contains the resistance of lamp 54.

In an alternate embodiment the blocking oscillator may be operated directly from a suitable direct current source without the need for a voltage reducer reducing transformer 18 and rectifying circuitry 22, 24 and 26. This embodiment would be especially useful as an emergency lighting system enabling the fluorescent lights to operate on a battery power source.

If a large scale lighting system is contemplated, a further embodiment becomes very attractive. In that embodiment the voltage reducing and rectifying circuit is placed at a central location near the source of primary alternating power, and the low voltage output of the rectifier, available at points 30 and 28 of the circuit, would then be distributed through the lighting system wiring and switching circuits, throughout the building, to the fluorescent lamp installation as indicated by the broken lines at 29 and 31. This embodiment has the advantage that low voltage wiring may be used throughout the building, thereby permitting the use of less expensive wiring and other components, and minimizing hazards associated with the distribution of the higher line voltage throughout the building.

It is contemplated that the rectifier and blocking oscillator circuits, including the autotransformer 56 would be packaged in a single package 85 resembling in size and shape the ballast transformer normally associated with fluorescent lamps. In using the present invention, the ballast transformer would be removed from the lamp fixture and would be replaced by the power supply of the present invention. This facilitates the change-over from conventional ballasting units which are wasteful of electrical power, to the power supply of the present invention thereby saving approximately 50% of the power now being consumed by conventional ballasting.

Although the embodiment of the present invention contemplated for commercial use strives for a 10% increase in light output from the fluorescent lamps over their normal output, it is possible with other embodiments to obtain a 200% or 300% increase in light output from the fluorescent lamps although shorter lamp life will result.

In the embodiment intended for commercial use, the lamp life is actually enhanced far beyond the normal lamp life by a factor of seven times. In addition, there is a saving in electrical power of approximately 30%.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. Apparatus for powering first and second fluorescent lamps connected in series, said lamps each having a starter heater filament, comprising:

a. a pair of sockets associated with each lamp, each socket having a terminal for making electrical connection to a lamp, with one of the terminals associated with each lamp connected in common;

b. an oscillator including two output terminals each of which is connected to the terminal of a socket associated with a different lamp but not to the terminals connected in common, and further including a feedback circuit including means for connecting a starter heater filament of the first lamp in series within the feedback circuit, whereby removal of the first lamp from its sockets disables said oscillator; and c. switching means for establishing a short circuit between the socket terminals of the second lamp when the lamp is removed from its sockets, whereby the socket terminals of the socket lamp are bypassed permitting power to continue to be applied to the socket terminals of the first lamp after the second lamp has been removed from its sockets.

2. The apparatus of claim 1 wherein said oscillator has an operating frequency in the range 20–25 kilohertz.

3. The apparatus of claim 1 wherein said oscillator is connected to a distribution system for supplying power to the fluorescent lamps at a distance, whereby lower voltage wiring may be used in the distribution system at a savings in cost.

4. The apparatus of claim 1 wherein said switching means is located in one of said lamp sockets.

5. The apparatus of claim 1 wherein said switching means comprises a contact yieldingly urged closed by resilient force when not normally held apart by a portion of a fluorescent lamp when the lamp is mounted in its sockets, whereby removal of the lamp from its sockets causes the contacts to close.

6. The apparatus of claim 1 wherein said oscillator is powered by a direct current power source.

7. The apparatus of claim 1 wherein said oscillator is a relaxation oscillator.

8. The apparatus of claim 7 wherein said relaxation oscillator is a blocking oscillator.

9. The apparatus of claim 1 in which said oscillator further includes converter means adapting said oscillator to be powered by a primary power source.

10. The apparatus of claim 9 wherein said converter means includes a rectifier circuit for providing direct current power to said oscillator from an alternating primary power source.

11. The apparatus of claim 9 wherein said converter means further include dimmer means for controlling the amount of power supplied to the fluorescent lamps whereby the fluorescent lamps may be operated at a reduced power level.

12. The apparatus of claim 9 wherein said oscillator and said converter means occupy the space normally used for a ballast element in a conventional fluorescent lamp fixture.

13. The apparatus of claim 9 wherein said converter means and said oscillator are included within a common enclosure.

14. In a circuit employing an oscillator circuit having a feedback loop for supplying operating current at a frequency in the range 20 to 25 kilohertz to a pair of fluorescent lamps connected in series, normally mounted in sockets, and having starter heater filaments, the improvement comprising:

a. means for connecting a starter heater filament of a first lamp in series within the feedback loop of the oscillator circuit, whereby removal of the first lamp from its sockets disables the oscillator circuit; and b. switching means for establishing a short circuit between the socket terminals of the second lamp when that lamp is removed from its sockets, whereby the socket terminals of the second lamp are bypassed permitting power to continue to be applied to the socket terminals of the first lamp after the second lamp has been removed from its sockets.

* * * * *